US008931881B1

(12) United States Patent
Sunaoshi

(10) Patent No.: US 8,931,881 B1
(45) Date of Patent: Jan. 13, 2015

(54) TREATMENT AGENT LIQUID APPLICATION APPARATUS FOR AN INKJET PRINTER

(71) Applicant: Masayuki Sunaoshi, Ibaraki (JP)

(72) Inventor: Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/312,646

(22) Filed: Jun. 23, 2014

(30) Foreign Application Priority Data

Jun. 25, 2013 (JP) ..... 2013-133010

(51) Int. Cl.
*B41J 2/015* (2006.01)
*B41J 2/21* (2006.01)
*B41J 2/175* (2006.01)

(52) U.S. Cl.
CPC ..... *B41J 2/2132* (2013.01); *B41J 2/17503* (2013.01)
USPC ..... 347/21

(58) Field of Classification Search
CPC ..... B41J 2/2114; B41J 11/0015; B41J 2/0057
USPC ..... 347/19, 21, 84–87, 93, 95, 101, 103
See application file for complete search history.

(56) References Cited

U.S. PATENT DOCUMENTS

| | | | | |
|---|---|---|---|---|
| 7,645,019 | B2 * | 1/2010 | Hirakawa | 347/21 |
| 8,764,160 | B2 * | 7/2014 | Sunaoshi | 347/21 |
| 2013/0106946 | A1 | 5/2013 | Sunaoshi | |

FOREIGN PATENT DOCUMENTS

| | | |
|---|---|---|
| JP | 08-072227 | 3/1996 |
| JP | 2013-091260 | 5/2013 |

* cited by examiner

*Primary Examiner* — An Do
(74) *Attorney, Agent, or Firm* — Duft Bornsen & Fettig LLP

(57) ABSTRACT

A inkjet printer treatment agent liquid application apparatus includes a supplying pan storing treatment agent liquid; a squeeze roller, partially immersed in the liquid stored in the supplying pan, drawing and transferring the liquid; an application roller applying the liquid transferred by the squeeze roller onto a recording medium surface; a press roller sandwiching and conveying the recording medium between the press roller and the application roller, pressing the recording medium against the application roller, transferring the liquid on the application roller onto the recording medium; a cartridge containing the liquid, to be exchangeably installed in a cartridge installation unit, and having an IC chip; a reader/writer reading/writing information from/to the IC chip; a liquid supply route connecting the installed cartridge and the supplying pan; a supplying pump placed on the liquid supply route; and a drive time measurement unit measuring a drive time of the supplying pump.

4 Claims, 5 Drawing Sheets

TREATMENT AGENT LIQUID APPLICATION APPARATUS FOR AN INKJET PRINTER

CROSS-REFERENCE TO RELATED APPLICATION

This patent application is based on and claims priority pursuant to 35 U.S.C. §119(a) to Japanese Patent Application No. 2013-0133010, filed on Jun. 25, 2013 in the Japan Patent Office, the entire disclosure of which is hereby incorporated by reference herein.

BACKGROUND OF THE INVENTION

1. Field of the Invention

The disclosures herein generally relate to a treatment agent liquid application apparatus for an inkjet printer which is used for applying treatment agent liquid, such as a blur suppressing agent for suppressing an image blur of a inkjet printer which forms an image on a recording medium by ejecting ink droplets onto the recording medium, on a recording surface of a recording medium prior to forming an image on the recording surface.

2. Description of the Related Art

Image forming which uses an ink droplet ejection method is becoming increasingly popular these days because of its advantage that its colorization can be easily realized, in addition to its advantages of low noise and low running cost. But, when an image is formed on a recording medium which is a non-manufacturer-specified paper, the image forming using an ink droplet ejection method has problems related to image robustness such as water resistance, weather resistance, etc., in addition to initial image quality problems related to image blur, image concentration, color tone, image show-through, etc. Therefore, many ideas have been proposed to solve these problems.

As one of the solutions to the problems, there is a method for improving the image quality by, prior to having ink droplets ejected onto a recording medium paper, applying a treatment agent liquid that has a function to cause the ink to aggregate. An image forming apparatus in which a roller is used for applying the treatment agent liquid onto a recording medium as a means for applying the treatment agent liquid is described in, for example, Japanese Patent Application Publication No. 8-72227 (Patent Document 1).

Regarding the image forming apparatus described in Patent Document 1, it has installed a replenishing tank, which is filled with treatment agent liquid and in which an application roller for applying the treatment agent liquid onto a fed before-image-forming recording medium is installed. In the replenishing tank, a float which is made of material whose specific gravity is less than that of the treatment agent liquid is included. Furthermore, a remaining liquid indication window is provided on a side of the replenishing tank, which side is visible from outside the image forming apparatus and the remaining liquid indication window shows an indication "Full" for indicating that the replenishing tank is full and, below the indication "Full", an indication "Add" for indicating that the replenishing tank should be replenished with the treatment agent liquid.

An operator, checking through the remaining liquid indication window the location of the float floating in the treatment agent liquid or the location of the liquid surface, is supposed to resupply the treatment agent liquid into the replenish tank when the location of the float or the liquid surface is near the indication "Add".

In the image forming apparatus described in Patent Document 1, however, there is a problem that it is necessary for the operator to check through the remaining liquid indication window the remaining amount of the treatment agent liquid in the replenishing tank, which may be a burden for the operator.

[Patent Document 1] Japanese Patent Application Publication No. 8-72227

SUMMARY OF THE INVENTION

It is a general object of at least one embodiment of the present invention to provide a treatment agent liquid application apparatus for an inkjet printer which is capable of detecting automatically the amount of the remaining treatment agent liquid in a cartridge to solve the above problem of the prior art without burdening an operator.

In a first embodiment, a treatment agent liquid application apparatus for an inkjet printer is provided. The treatment agent liquid application apparatus includes a supplying pan configured to store treatment agent liquid; a squeeze roller, partially immersed in the treatment agent liquid stored in the supplying pan, configured to draw and transfer the treatment agent liquid onto an application roller; the application roller configured to apply the treatment agent liquid transferred by the squeeze roller onto a recording surface of a recording medium; a press roller configured to sandwich and convey the recording medium between the press roller and the application roller, to press the recording medium toward a side of the application roller, to transfer the treatment agent liquid on the application roller onto the recording medium; a cartridge configured to contain the treatment agent liquid, to be exchangeably installed in a cartridge installation unit, and to be equipped with an IC chip; a reader/writer configured to read and write information of the IC chip; a treatment agent liquid supply route configured to connect the installed cartridge and the supplying pan; a supplying pump configured to be placed on the treatment agent liquid supply route; and a drive time measurement unit configured to measure a drive time of the supplying pump. Based on the drive time of the supplying pump measured by the drive time measurement unit, supplied amount of the treatment agent liquid supplied by the cartridge to the supplying pan is calculated, and liquid weight information in which the supplied amount is subtracted is written to the IC chip by the reader/writer.

In a second embodiment, a treatment agent liquid application apparatus for an inkjet printer is provided. The treatment agent liquid application apparatus includes a supplying pan configured to store treatment agent liquid; a squeeze roller, partially immersed in the treatment agent liquid stored in the supplying pan, configured to draw and transfer the treatment agent liquid onto an application roller; the application roller configured to apply the transferred treatment agent liquid onto a recording surface of a recording medium; a press roller configured to sandwich and convey the recording medium between the press roller and the application roller, to press the recording medium toward a side of the application roller, to transfer the treatment agent liquid on the application roller onto the recording medium; a plurality of cartridges, each of which is configured to contain the treatment agent liquid, to be exchangeably installed in a cartridge installation unit, and to be equipped with an IC chip; a reader/writer configured to read and write information of the IC chip; a treatment agent liquid supply route configured to connect each of the installed cartridges and the supplying pan; a supplying pump configured to be placed on the treatment agent liquid supply route; a plurality of supply valves, one of which is placed for each of the cartridges and that are used for selecting one of the cartridges for supplying the treatment agent liquid; a drive time measurement unit configured to measure a drive time of the supplying pump; and a release time measurement unit configured to measure a release time of the supplying valve. Based on an overlapped time between the drive time of the supplying pump measured by the drive time measurement unit and the release time of the supplying valve measured by the release time measurement unit, a supplied amount of the treatment agent liquid supplied by the cartridge to the supplying pan is calculated, and liquid weight information in which the supplied amount is subtracted is written by the reader/writer onto the IC chip, with which the cartridge for supplying the treatment agent liquid selected by the supplying valve is equipped.

The embodiments of the present invention are configured as described above and are capable of providing a treatment agent liquid application apparatus for an inkjet printer which is capable of detecting automatically the amount of the remaining treatment agent liquid in a cartridge without burdening an operator.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

Figure 1:
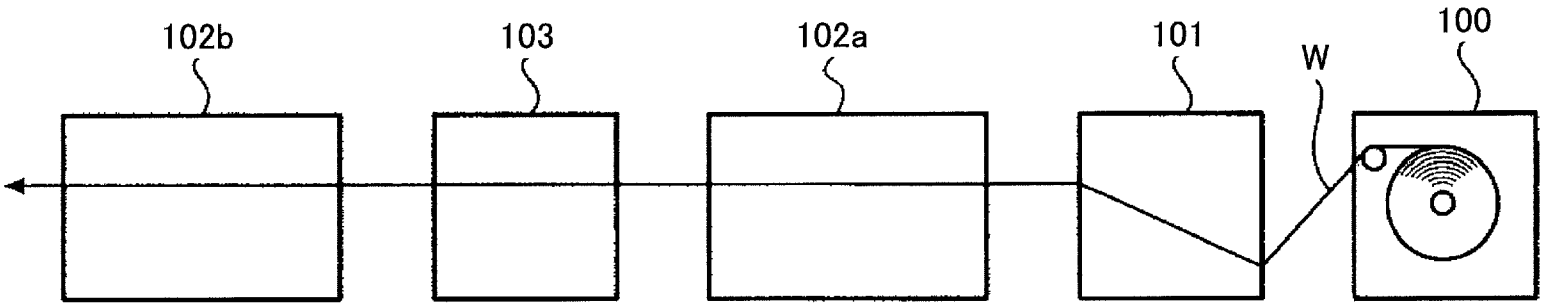
FIG. 1 is a work flowchart which shows a work flow of an image forming system according to an embodiment of the present invention.

In the following, embodiments of the present invention will be described with reference to the accompanying drawings. FIG. 1 is a flowchart which shows a work flow of an image forming system according to an embodiment of the present invention.

As shown in the figure, a recording medium W including, for example, an elongated continuous paper sheet fed out from a feeding paper apparatus 100 is conveyed first into a treatment agent liquid application apparatus 101, and preprocessing is applied to the recording medium, in which preprocessing, treatment agent liquid, such as the blur suppressing agent, is applied to the front surface and the rear surface of the recording medium W. Then, the preprocessed recording medium W is conveyed into a first inkjet printer 102*a* and a desired image is formed on the front surface of the recording medium W by having ink droplets ejected onto the front surface. After that, the front surface and the rear surface of the recording medium are inverted by an inverting apparatus 103. Then, the recording medium W is continued to be conveyed into a second inkjet printer 102*b* and a desired image is formed onto the rear surface of the recording medium by having ink droplets ejected onto the rear surface. After having the desired images formed on both of the surfaces of the recording medium W in this way, the recording medium W is conveyed into a post-processing apparatus (not shown in the figure) and a predefined post-process is performed in the image forming system.

Figure 2:
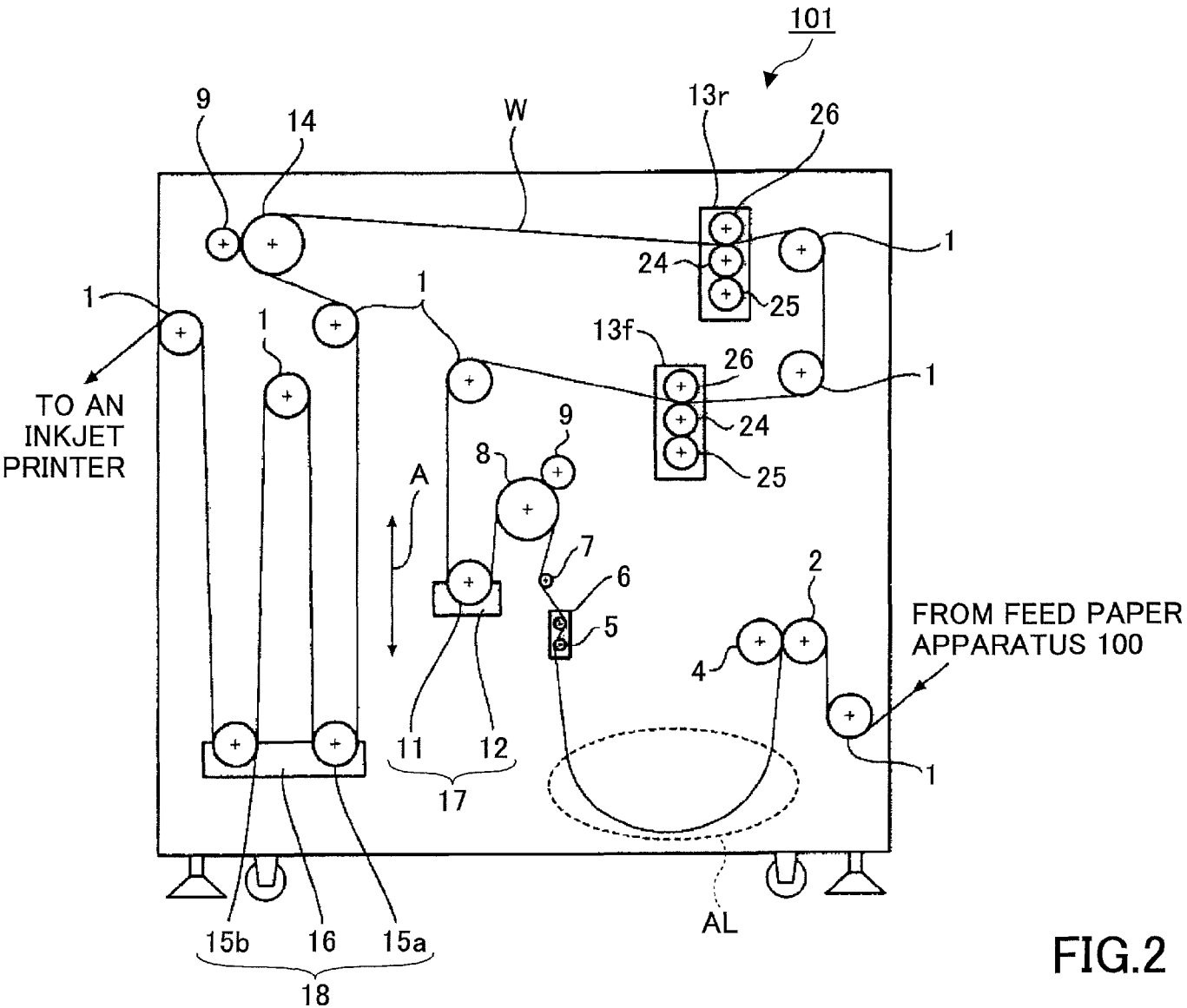
FIG. 2 is a schematic configuration diagram of a treatment agent liquid application apparatus used in the image forming system.

FIG. 2 is a schematic configuration diagram of the treatment agent liquid application apparatus 101 used in the image forming system. FIG. 2 shows the state when the treatment agent liquid is applied. As shown in FIG. 2, many rotation-free guide-rollers 1 with bearings at both ends of the rollers (not shown in the figure) are installed in the treatment agent liquid application apparatus 101, which secures the conveying path for the recording medium W.

Reference sign 2 in the figure indicates an FI roller (Feed In roller) which is rotationally driven by a driving source such as a motor (not shown in the figure). Onto the FI roller 2, pressed by pull force of a spring (not shown) is an FI nip roller (Feed-in nip roller) 4.

The recording medium W is elastically nipped between the FI roller 2 and the FI nip roller 4. By rotating the FI roller 2 by the driving source, the recording medium W can be pulled from the feeding paper apparatus 100 into the inside of the treatment agent liquid application apparatus 101.

Also, the recording medium W pulled out from the FI roller 2 and the FI nip roller 4 is caused to become slack and forms an air loop AL. After passing the air loop AL, the recording medium W goes through pass shafts 5 and edge guides 6. It is not shown in the figure but two pass shafts 5 are arranged in the direction orthogonal to the conveyance direction of the recording medium W and the recording medium W goes through between the pass shafts 5 forming the shape of S. A pair of the plate-like edge guides 6 are supported by the pass shafts 5, and the gap between the edge guides 6 is set the same size as the width of the recording medium W.

As a result, by the action of the pass shafts 5 and the edge guides 6, the running position of the recording medium W in the width direction is regulated, and the stable running of the recording medium W becomes possible. It should be noted that the edge guides 6 are fixed to the pass shafts 5 by fixing units such as screws and that the positions of the edge guides 6 are adjustable according to the width of the recording medium W to be used.

The recording medium W, after going through the pass shafts 5 and the edge guides 6, has tension applied for stabilization of the running of the paper by a tension shaft 7 which is in a fixed state.

The recording medium W, after passing the tension shaft 7, goes through between an in-feed roller 8, which is rotationally driven by a driving source such as a motor (not shown in the figure), and feed-nip rollers 9. The multiple feed-nip rollers 9 (not shown in the figure) are arranged along the axis direction of the in-feed roller 8. Each of the feed-nip rollers 9 is pressed onto the side of the in-feed roller 8 by a spring (not shown in the figure).

The recording medium W, after passing between the in-feed roller 8 and the feed-nip roller 9, is rolled around from the lower side of a rotation-free first dancer roller 11.

The first dancer roller 11 is rotation-freely attached to a first movable frame 12 via bearings at both ends of the roller (not shown in the figure), which is the configuration of a first dancer unit 17. As a result, the first dancer unit 17 is in a state in which the first dancer unit 17 is suspended by the recording medium W.

This first dancer unit 17 is movable along the gravity direction indicated by arrow A. A first dancer unit location detection unit (not shown in the figure) is provided for detecting the location of the first dancer unit 17. The location of the first dancer unit 17 is adjusted by controlling drive of a driving source of the in-feed roller 8 according to an output of the first dancer unit location detection unit.

After passing the first dancer unit 17, the recording medium W sequentially passes a front surface application unit 13*f* which applies the treatment agent liquid on the front surface of the recording medium W, and a rear surface application unit 13*r* which applies the treatment agent liquid on the rear surface of the recording medium W. As a result, both surfaces of the recording medium W have the treatment agent liquid applied. The treatment agent liquid application units 13 (13*f*, 13*r*) will be described later.

After passing the rear surface application unit 13*r*, the recording medium W passes between an out-feed roller 14 which is rotationally driven by a driving source such as a motor (not shown in the figure) and a feed-nip roller 9. It is now shown in the figure but the multiple feed-nip rollers 9 are placed along the direction of the axis of the out-feed roller 14, and each of the feed-nip rollers 9 is pressed against the side of the out-feed roller 14 by a spring.

After passing between the out-feed roller 14 and the feed-nip rollers 9, the recording medium W is rolled over around rotation-free second dancer rollers 15*a* and 15*b*, and around a guide roller 1 which is placed between the dancer rollers 15*a* and 15*b*, forming the shape of letter W.

The dancer rollers 15*a* and 15*b* are rotation-freely attached to a second movable frame 16 via bearings at both ends of the dancer rollers 15*a* and 15*b*, respectively, (not shown in the figure), which is the configuration of a second dancer unit 18. As a result, the second dancer unit 18 is also in a state suspended by the recording medium W.

This second dancer unit 18 is also movable along the gravity direction indicated by arrow A. A second dancer unit location detection unit (not shown in the figure) is provided for detecting the location of the second dancer unit 18. The location of the second dancer unit 18 is adjusted by controlling drive of a driving source of the out-feed roller 14 according to an output of the second dancer unit location detection unit.

Figure 3:
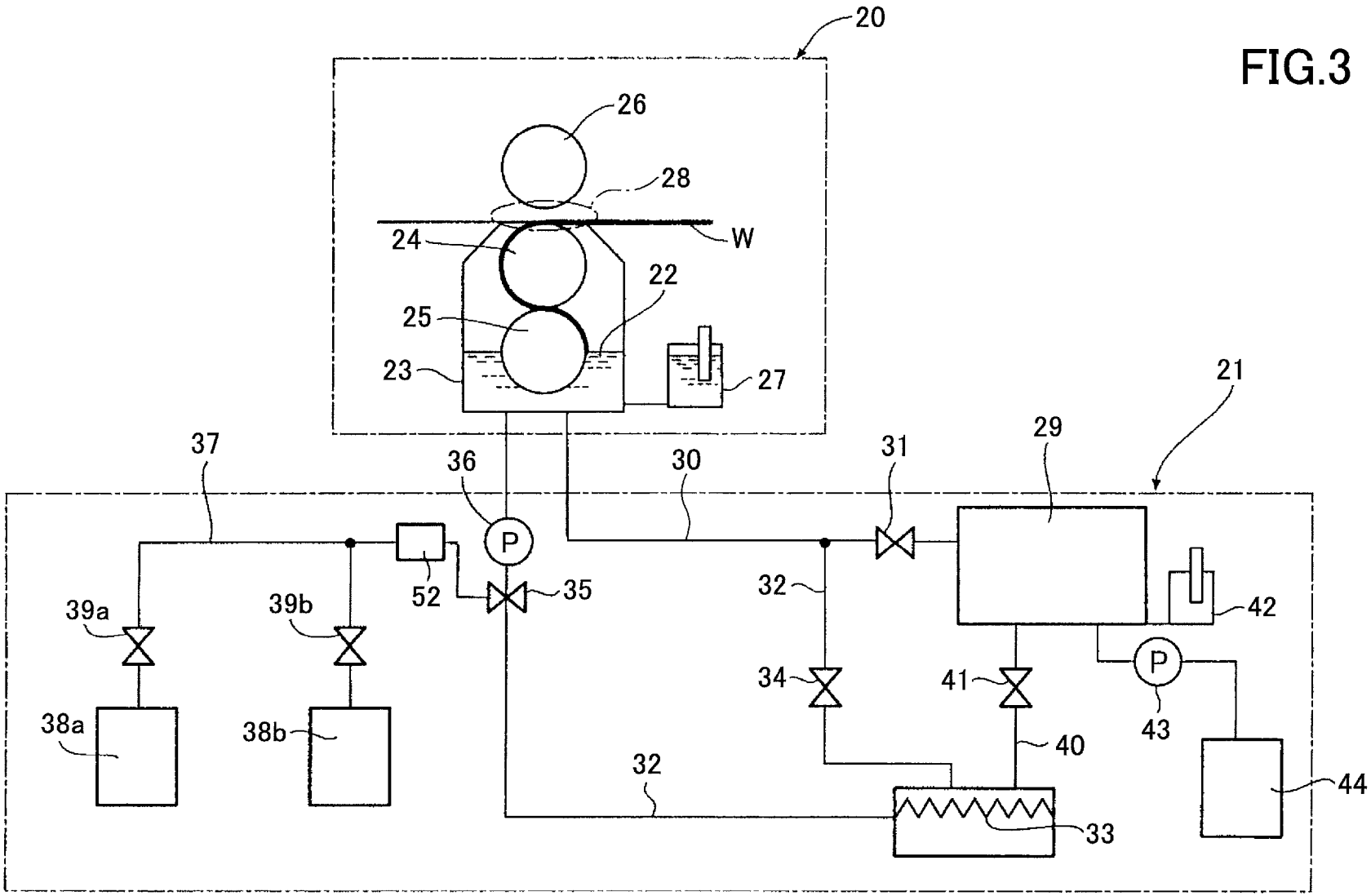
FIG. 3 is a schematic configuration diagram of an application unit in the treatment agent liquid application apparatus.

FIG. 3 is a schematic configuration diagram of the application unit 13 (13*f* or 13*r*). The application unit 13 mainly include a recording medium conveyance unit which conveys the recording medium W in the predefined direction, a treatment agent liquid application unit 20 which applies treatment agent liquid 22 onto the recording medium W, and a treatment agent liquid supplying unit 21 which supplies the treatment agent liquid 22 to the treatment agent liquid application unit 20.

The recording medium conveyance unit is configured with the guide rollers 1, the in-feed roller 8 and the feed-nip roller 9, the out-feed roller 14 and the feed-nip roller 9, etc., and is not shown in FIG. 3.

The treatment agent liquid application unit 20 is provided on the conveyance route of the recording medium W, and includes a supplying pan 23 for storing the treatment agent liquid 22, an application roller 24 for applying the treatment agent liquid 22 onto the recording medium W, a squeeze roller 25 for forming a thin film of the treatment agent liquid 22 and transferring the thin film onto the application roller 24, a press roller 26 for sandwiching the recording medium W between the application roller 24 and the press roller 26, a liquid surface detection sensor 27 for detecting the volume of the treatment agent liquid 22 in the supplying pan 23, etc., whose location relationships are shown in FIG. 3.

Regarding the treatment agent liquid 22, liquid is used in which a water soluble flocculant that has a function of making soluble color material to aggregate or making it insoluble is dissolved or dispersed in water or organic solvent.

As shown in FIG. 3, the squeeze roller 25 is immersed in the treatment agent liquid 22 in the supplying pan 23 and the treatment agent liquid 22 is drawn from the supplying pan 23 by the squeeze roller 25 which is rotationally driven by a motor (not shown in the figure). Regarding the squeeze roller 25, if a roller whose peripheral surface is grooved, such as an Anilox roller or a wire bar, is used, it has an advantage that it is easy to control a liquid amount because it receives almost no impact from the viscosity of the treatment agent liquid when it is drawn from the supplying pan 23 or from the print speed.

After being drawn from the supplying pan 23 by the squeeze roller 25, the treatment agent liquid 22 has the excess amount removed by a metering blade (not shown in the figure), so that the defined amount is carried to the nip portion formed by the application roller 24 and the squeeze roller 25. After being carried to the nip portion formed by the application roller 24 and the squeeze roller 25, the treatment agent liquid 22 is evenly spread in the axis direction between the application roller 24 and the squeeze roller 25, forming a thin film, and is transferred onto the application roller 24. The application roller 24, whose peripheral surface is covered by elastic material such as rubber, is rotationally driven by a motor (not shown in the figure).

The treatment agent liquid 22 which is transferred onto the application roller 24 is applied onto the recording medium W which is sandwiched by the application roller 24 and the press roller 26 and conveyed between them. Then, after having the treatment agent liquid applied, the recording medium W is conveyed to an ink jet printer 102 (see FIG. 1). The application roller 24, after transferring the treatment agent liquid 22 onto the recording medium W, is cleaned by a cleaner blade (not shown in the figure) and is prepared for the next application of the treatment agent liquid 22.

The amount of the treatment agent liquid 22 in the supplying pan 23 is detected by the liquid surface detection sensor 27 which is attached to the supplying pan 23. When the liquid surface of the treatment agent liquid 22 in the supplying pan 24 becomes lower than a specified height because of the consumption of the treatment agent liquid 22 by repeated printing, the treatment agent liquid 22 is supplied to the supplying pan 23. When the liquid surface of the treatment agent liquid 22 in the supplying pan 24 reaches the specified height, the supply of the treatment agent liquid 22 is stopped based on a detection signal of the liquid surface detection sensor 27, thus the amount of the treatment agent liquid 22 in the supplying pan 23 is kept constant. The supply of the treatment agent liquid 22 to the supplying pan 23 will be described later.

The top portion of the supplying pan 23 is formed to cover the application roller 24, which provides a configuration for suppressing the evaporation of the treatment agent liquid 22 in the supplying pan 23. However, it is difficult to make it a complete sealed configuration (closed system) because it is necessary to keep open the portion corresponding to the contact portion 28 for the application roller 24 in the supplying pan 23 and the press roller 26 outside the supplying pan 23. For this reason, a reserve tank 29 which is almost a closed system is attached to the treatment agent liquid supplying unit 21 of the application unit 13.

This reserve tank 29 has enough space for accommodating the treatment agent liquid stored in the supplying pan 23. As shown in FIG. 3, the reserve tank 29 communicates with the supplying pan 23 through an evacuation route 30. An electromagnetic valve 31 is attached in front of the reserve tank 29 on the evacuation route 30.

In order to create a liquid surface gap (height difference) between the supplying pan 23 and the reserve tank 29, the reserve tank 29 is placed in a position lower than the supplying pan 23. When the treatment agent liquid 22 is not used for a long period of time, by releasing the electromagnetic valve and taking advantage of the liquid surface gap, the treatment agent liquid 22 stored in the supplying pan 23 is moved to the reserve tank 29 which has a higher airtightness, which configuration suppresses the viscosity increase due to the drying of the treatment agent liquid 22.

It should be noted that the timing of the release of the electromagnetic valve 31 is, for example, when the recording medium W in the treatment agent liquid application apparatus 101 is replaced with a new one, or when printing is stopped for a time longer than a normal setup time for, for example, changing print patterns between print jobs, for more than one hour, for example. Thus a situation is prevented that a waiting time needs to be created for the treatment agent liquid 22 to be restored in the supplying pan 23 every time printing is stopped.

Furthermore, a normal-open-type valve is used for the electromagnetic valve 31, which is released in the case where no electricity is supplied, thereby a configuration is provided in which in the case where the power supply of the treatment agent liquid application apparatus 101 is stopped, the treatment agent liquid 22 in the supplying pan 23 is automatically moved to the reserve tank 29, which prevents the treatment agent liquid 22 being left for a long period of time in the supplying pan 23 with a low airtightness.

A circulation route 32 diverges from the middle of the upstream side of the electro-magnetic valve 31 on the evacuation route 30, and the end of the circulation route 32 is eventually connected to the supplying pan 23. In the middle of the circulation route 32, there is a filter 33. An electromagnetic valve 34 is located between the filter 33 and the connection point of the evacuation route 30 and the circulation route 32. In the meantime, a three-way valve 35 is located on the exit side of the filter 33 and a supplying pump 36 is located between the three-way valve 35 and the supplying pan 23.

For this reason, a configuration is provided in which, from time to time during the application of the treatment agent liquid 22, by driving the supplying pump 36 while closing the electromagnetic valve 31 of the evacuation route 30, opening the electromagnetic valve 34, and making the three-way valve 35 be in a state where the filter 33 is communicating with the supplying pan 23, part of the treatment agent liquid 22 stored in the supplying pan 23 can go through the filter 33.

By this, foreign matter such as paper powder, which is created by sliding movement of the recording medium W against the application roller 24 and the press roller 26 and is precipitating in the supplying pan 23, can be removed by the filter 33, which prevents the treatment agent liquid 22 in the supplying pan 23 from becoming sticky paste.

Also, a circulation supplying route 40 is provided between the reserve tank 29 and the filter 33, and an electromagnetic valve 41 is placed between the reserve tank 29 and the filter 33. Therefore, while closing the electromagnetic valve 31 of the evacuation route 30 and closing the electromagnetic valve 34 of the circulation route 32, opening the electromagnetic valve 41, and making the three-way valve 35 be in a state where the filter 33 is communicating with the supplying pan 23, by driving the supplying pump 36, the treatment agent liquid 22 stored in the reserve tank 29 can be supplied to the supplying pan 23 through the filter 33.

Furthermore, the three-way valve 35 is connected to a treatment agent liquid supply route 37. To the free end side of the treatment agent liquid supply route 37, one or more sealed cartridges 38 (38*a*, 38*b*) filled with treatment agent liquid 22 are exchangeably installed in parallel. To the exit sides of the cartridges 38, electromagnetic valves 39 (39*a*, 39*b*) are attached.

Therefore, while closing the electromagnetic valves 31, 34 and 41, and making the three-way valve 35 be in a state where the cartridge 38 (38*a* or 38*b*) is in communication with the supplying pan 23, by driving the supplying pump 36 with the electromagnetic valve 39 open, the treatment agent liquid 22 in the cartridge 38 (38*a* or 38*b*) can be supplied to the supplying pan 23.

As described above, the present embodiment includes, as systems for supplying the treatment agent liquid 22 to the supplying pan 23, a system in which the treatment agent liquid 22 in use which is purified through the filter 33 is provided to the supplying pan 23; and a system in which brand-new treatment agent liquid 22 in the cartridge 38 is supplied to the supplying pan 23. Furthermore, as systems for supplying the treatment agent liquid 22 to the filter 33, there are two systems: a system for supplying the treatment agent liquid 22 to the filter 33 through the evacuation route 30, the reserve tank 29, and the circulation supplying route 40; and a system for supplying the treatment agent liquid 22 to the filter 33 through the evacuation route 30 and the circulation route 32.

To the reserve tank 29, the liquid surface detection sensor 42 is attached. The liquid surface detection sensor 42 monitors the amount of the treatment agent liquid 22 in the reserve tank 29. Based on a detection signal from the liquid surface detection sensor 42, the supplying of the treatment agent liquid 22 from the reserve tank 29 and the supplying of the treatment agent liquid 22 from the cartridge 38 are automatically switched by a control unit (not shown in the figure) of the treatment agent liquid application apparatus.

In other words, a configuration is provided in which when it is detected by the liquid surface detection sensor 42 that there is no treatment agent liquid 22 left in the reserve tank 29, the treatment agent liquid 22 is supplied from the cartridge 38, and in the case where there are multiple cartridges 38, a cartridge 38 for supplying the treatment agent liquid 22 is selected by the control unit (not shown in the figure) by using the electromagnetic valve attached to the selected cartridges 38.

In other words, in the case where there are multiple cartridges 38, by driving the supplying pump 36 while keeping the three-way valve in a state where the cartridge 38 is in communication with the supplying pan 23, when, for example, the electromagnetic valve 39*a* is opened, the treatment agent liquid 22 is supplied from the cartridge 38*a*. When the cartridge 38*a* becomes empty, then, by opening the electromagnetic valve 39*b*, the treatment agent liquid 22 is supplied from the cartridge 38*b*. It is predetermined which cartridge should be selected first for supplying the treatment agent liquid 22.

The supplying time of the treatment agent liquid 22 from the cartridge 38*b* is a time when the supplying pump 36 is being driven and at the same time the electromagnetic valve 39 is being kept open, which is an AND logical condition of the drive time of the supplying pump 36 and the open time of the electromagnetic valve 39. A drive time measurement unit for measuring the drive time of the supplying pump 36 and an electromagnetic valve open time measurement unit for measuring the open time of the electromagnetic valve 39 measure time by using a timer included in a control unit of the apparatus side (not shown in the figure).

It should be noted that in the case where there is the treatment agent liquid 22 in the reserve tank 29, while closing the electromagnetic valve 34 of the circulation route 32, opening the electromagnetic valve 41 of the circulation supplying route 40, and keeping the three-way valve in a state where the reserve tank 29 (filter 33) is in communication with the supplying pan 23, by driving the supplying pump 36 and supplying the treatment agent liquid 22 in the reserve tank 29 to the supplying pan 23, the amount of the treatment agent liquid 22 in the reserve tank 29 is kept within a constant value range.

Also, there is an advantage that the treatment agent liquid 22 moved to the reserve tank 29 is refreshed because it goes through the filter 33 when it is resupplied to the supplying pan 23 through the circulation supplying route 40.

The sign 43 in FIG. 3 indicates a waste liquid pump and 44 indicates a waste liquid tank. Because the quality of the treatment agent liquid 22 tends to gradually degrade when it is used continuously, it is necessary that the treatment agent liquid 22 be discarded and replaced with new treatment agent liquid 22 periodically or as necessary. Therefore, the waste liquid pump 43 and the waste liquid tank 44 are provided.

It should be noted that the evaluation route 30, the circulation route 32, the supplying route 37, the circulation supplying route 40, etc., are configured with, for example, flexible tubes such as resin tubes.

Figure 4:
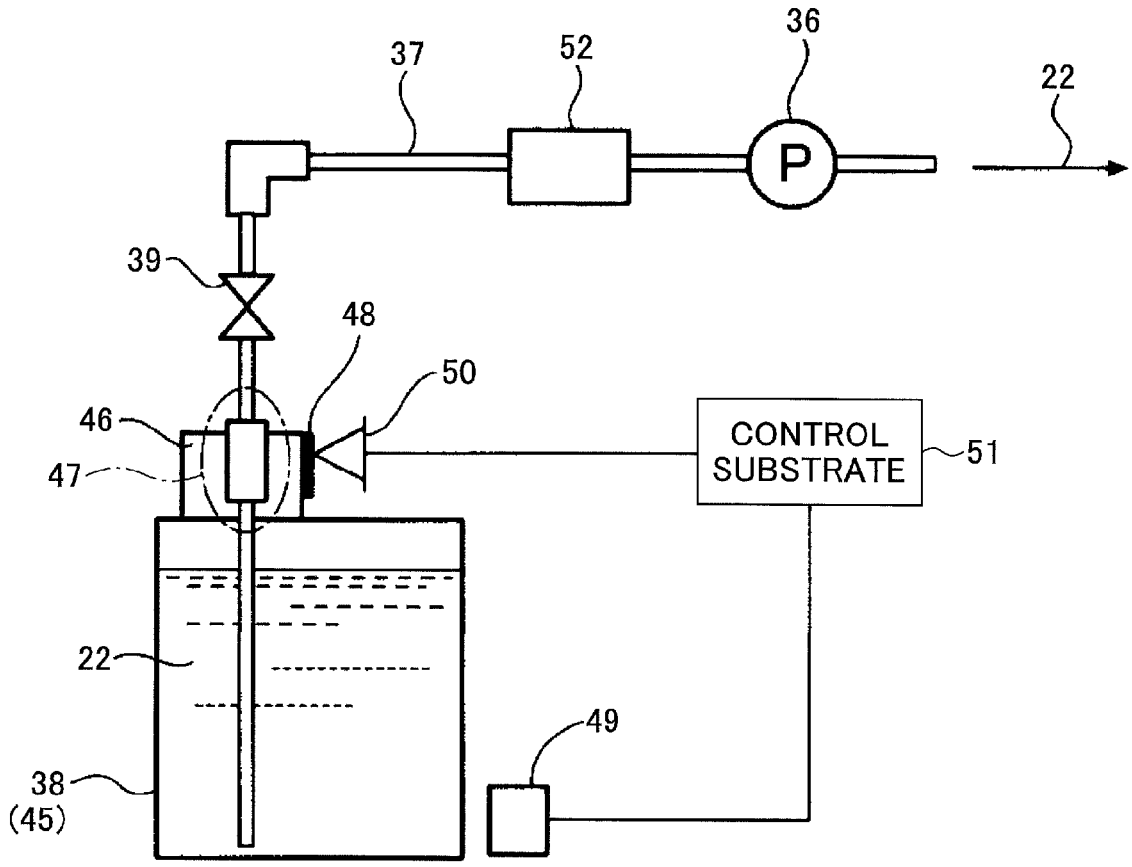
FIG. 4 is a schematic configuration diagram illustrating configurations of a cartridge and a cartridge installation unit used in the application unit.

FIG. 4 is a schematic configuration diagram illustrating a configuration of the cartridge 38 and a cartridge installation unit. As shown in FIG. 4, the cartridge 38 includes a container 45 and a cap 46 located at the liquid outlet of the container 45. The cap 46 includes a connection unit 47 for the treatment agent liquid application apparatus and an IC chip 48. To the connection unit 47, the treatment agent supplying route 37 is configured to be connected.

The cartridge installation unit of the treatment agent liquid application apparatus is provided with a set sensor 49 made of a micro switch, etc., for detecting whether the cartridge 38 is set or not. Also, an IC chip reader/writer 50 is provided at a neighboring location facing the IC chip 48 of the cartridge 38 which is set in the cartridge installation unit. The IC chip reader/writer 50 and the set sensor 49 are connected to a control substrate 51.

Also, an empty sensor 52 is attached to the downstream side of the electromagnetic valve 39 of the treatment agent liquid application apparatus. The role of the empty sensor 52 will be described later in a flowchart of FIG. 5.

Figure 5:
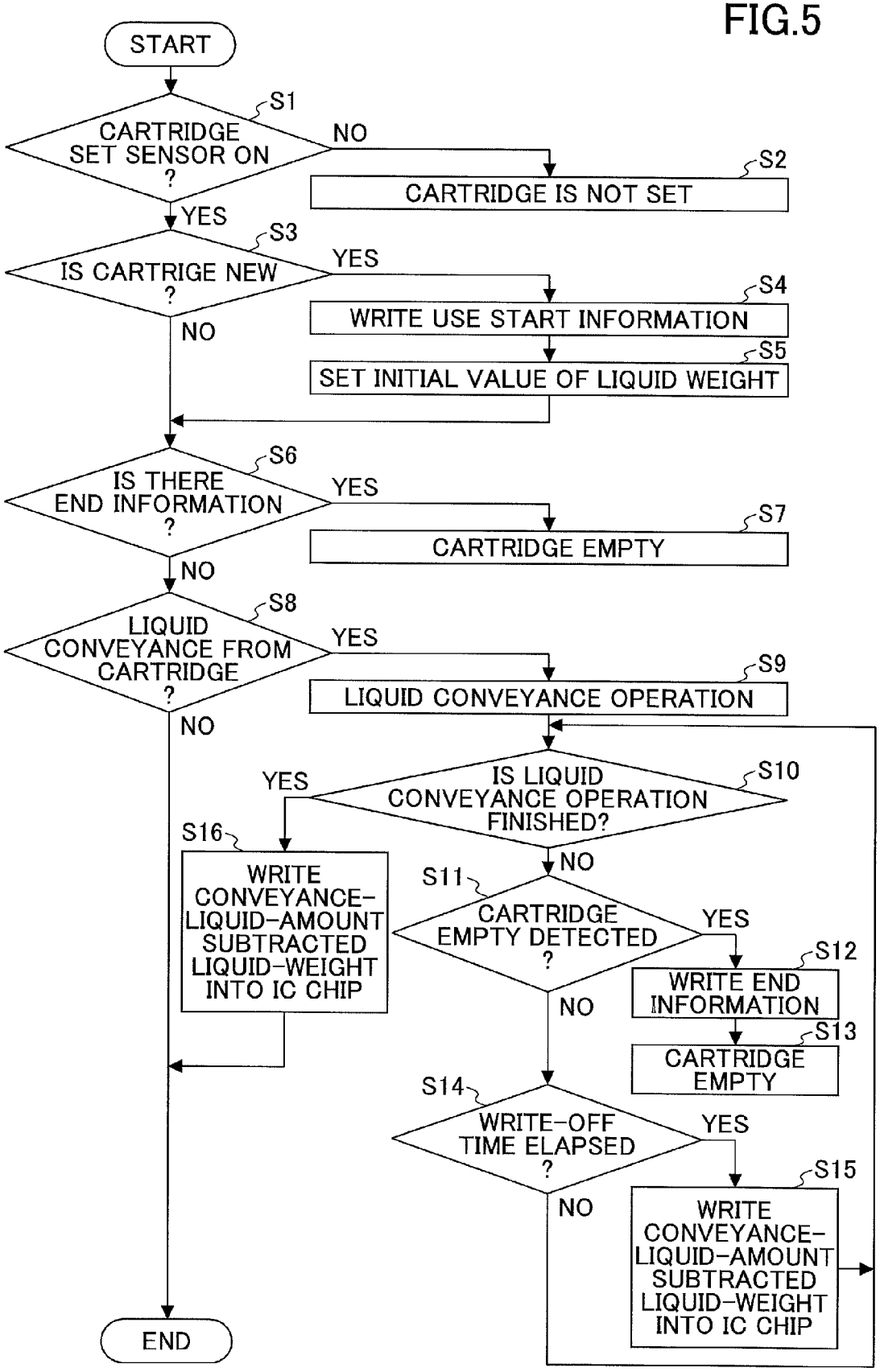
FIG. 5 is a flowchart illustrating control of supplying treatment agent liquid by the cartridge.

FIG. 5 is a flowchart illustrating supply control of the treatment agent liquid 22 by the cartridge 38.

First, in step (hereinafter referred to as S) 1, it is determined whether the set sensor 49, which detects whether the cartridge 38 is set, is ON. If the set sensor 49 is not ON, then in S2, as the cartridge 38 is not set, power is not provided for the IC chip 48, and a supplying operation of the treatment agent liquid 22 from the cartridge 38 is not performed.

If the cartridge 38 is set, then the IC chip 48 contacts the IC chip reader/writer 50 and the set sensor 49 detects that the cartridge 38 is set (YES in S1), and the power is provided for the IC chip 48 through the IC chip reader/writer 50.

Moving to S3, it is determined whether the set cartridge 38 is new. This determination is made by determining whether the IC chip reader/writer 50 has read use start information (to be described later) which should be written into the IC chip 48 attached to the cartridge 38.

In the case where the cartridge 38 is new (YES in S3), the use start information is written into the IC chip 48 of the cartridge 38 by the IC chip reader/writer 50 (S4) and an initial value of the weight of the treatment agent liquid 22 is written (S5). When the cartridge 38 is new, the weight of the treatment agent liquid is known, and the weight is written as the initial value.

In the case where it is determined that the cartridge 38 is not new in S3, moving to S6, it is determined whether end information is written in the IC chip 48. In the case where the end information is written (YES in S6), or in the case where the cartridge 38 is empty, a report of an empty cartridge is sent to the control unit of the apparatus side (not shown in the figure) through the control substrate 51 which is connected to the IC chip reader/writer 50 (S7) so that the supplying operation of the treatment agent liquid 22 from the cartridge 38 will not be performed.

In the case where it is determined that the end information is not written in S6 (NO in S6), or in the case where there is the treatment agent liquid 22 in the cartridge 38, a report of a supply capable cartridge is sent to the control unit of the apparatus side through the control substrate 51; and in S8, it is determined whether the supply of the treatment agent liquid 22 from the cartridge 38 should be performed.

If the supply of the treatment agent liquid 22 is not performed (NO for S8), then the control routine is finished. Note that the determination whether supplying the treatment agent liquid 22 from the cartridge 38 should be performed is made by the control unit of the apparatus side based on the detection signal from the liquid surface detection sensor 27 (refer to FIG. 3) which detects the remaining amount of the treatment agent liquid 22 in the supply pan 23.

On the other hand, if the supply of the treatment agent liquid 22 is performed (YES for S8), the treatment agent liquid 22 is supplied from the cartridge 38 by driving the supply pump 36 on the treatment agent liquid supply route 37 and opening the electromagnetic valve 39 (refer to FIG. 3) (S9).

At this time, in the control substrate 51, an operation is performed in which, assuming that 2 g of the treatment agent liquid 22 is conveyed in every 0.14 seconds, the amount of conveyed liquid is counted and remaining amount information of the IC chip 48 is rewritten in every 10 seconds.

In S10, it is determined whether the liquid conveyance operation of the treatment agent liquid 22 for the supplying pan 23 is finished. This determination whether the liquid conveyance operation is finished is made based on the detection signal of the liquid surface sensor 27 which monitors the position of the liquid surface of the treatment agent liquid 22 in the supplying pan 23.

If it is determined that the liquid conveyance operation is not finished (NO for S10), then it is determined whether the cartridge 38 is cartridge-empty in S11. This cartridge-empty is detected by an empty sensor 52 located on the treatment agent liquid supply route 37. This empty sensor 52 is configured to detect an existence of flow of treatment agent liquid 22 in the tube by utilizing refraction of light.

In S12, as it is determined that the cartridge is in an empty state, or the inside of the cartridge 38 is empty, the end information (empty information) is written into the IC chip 48. Then, in S13, it is reported as cartridge-empty to the control unit of the apparatus side through the control substrate 51. In order to stop the liquid conveyance from the cartridge 38, the control unit performs a closing operation of the electromagnetic valve 39 by outputting an instruction signal for closing the electromagnetic valve 39.

In the case where the cartridge 38 is not empty (NO for S11), in S14, it is determined whether a write-OFF time, during which no writing is performed for the IC chip 48, has elapsed, and if the write-OFF time has elapsed, then, in S15, the liquid weight amount (remaining amount) in which a conveyed amount of liquid is subtracted is written to the IC chip 48 and the flow returns to step S10. In the case where the write-OFF time has not elapsed in S14, the flow also returns to step S10.

If it is determined that the desired liquid conveyance operation is finished in S10 (YES for S10), moving to S16, the liquid weight amount (remaining amount) in which conveyed amount of liquid is subtracted is written to the IC chip 48, and the control routine is finished.

In FIG. 1, a case is described in which images are formed on both sides of the recording medium W. In the case where an image is formed on a single side, it is possible to perform single-side printing using the same system by not using the inverting apparatus 103 and the second inkjet printer 102*b* shown in FIG. 1, and by separating the press roller 26 of the rear surface application unit 13*r* of the treatment agent liquid application apparatus 101 from the application roller 24 shown in FIG. 2.

Also, it is possible to perform single-side printing by including one front surface application unit in the treatment agent liquid application apparatus and applying the treatment agent liquid 22 onto the front surface of the recording medium W. Furthermore, it is also possible to perform single-side printing by including two front surface application units continuously, and applying twice the treatment agent liquid onto the front surface of the recording medium W.

In the embodiment, as shown in FIG. 3, the filter 33 is provided in the middle of the circulation route 32. It may be possible that the filter 33 is provided between the supplying pan 23 and the branch point from the evacuation route 30 to the circulation route 32.

In the embodiment, as shown in FIG. 4, the IC chip 48 is included in the cap 46 of the cartridge 38. It is possible to include the IC chip in the container 45 of the cartridge 38.

Further, the present invention is not limited to these embodiments, and various variations and modifications may be made without departing from the scope of the present invention.

The present application is based on and claims the benefit of priority of Japanese Priority Application No. 2013-133010 filed on Jun. 25, 2013, the entire contents of which are hereby incorporated by reference.

What is claimed is:

1. A treatment agent liquid application apparatus for an inkjet printer, comprising:

a supplying pan configured to store treatment agent liquid;

a squeeze roller, partially immersed in the treatment agent liquid stored in the supplying pan, configured to draw and transfer the treatment agent liquid;

an application roller configured to apply the treatment agent liquid transferred from the squeeze roller onto a recording surface of a recording medium;

a press roller configured to sandwich and convey the recording medium between the press roller and the application roller, to press the recording medium against the application roller to transfer the treatment agent liquid on the application roller onto the recording medium;

a cartridge configured to contain the treatment agent liquid, to be exchangeably installed in a cartridge installation unit, and to be equipped with an IC chip;

a reader/writer configured to read and write information from and to the IC chip;

a treatment agent liquid supply route configured to connect the installed cartridge and the supplying pan;

a supplying pump configured to be placed on the treatment agent liquid supply route; and a drive time measurement unit configured to measure a drive time of the supplying pump, wherein, based on the drive time of the supplying pump measured by the drive time measurement unit, a supplied amount of the treatment agent liquid supplied from the cartridge to the supplying pan is calculated, and liquid weight information in which the supplied amount is subtracted is written to the IC chip by the reader/writer.

2. The treatment agent liquid application apparatus for an inkjet printer as claimed in claim 1, further comprising an empty detection unit configured to detect that the cartridge becomes empty of the treatment agent liquid, wherein when it is detected that the cartridge becomes empty by the empty detection unit, information indicating the cartridge is empty is written by the reader/writer onto the IC chip with which the cartridge is equipped.

3. A treatment agent liquid application apparatus for an inkjet printer, comprising:

a supplying pan configured to store treatment agent liquid;

a squeeze roller, partially immersed in the treatment agent liquid stored in the supplying pan, configured to draw and transfer the treatment agent liquid;

an application roller configured to apply the transferred treatment agent liquid onto a recording surface of a recording medium;

a press roller configured to sandwich and convey the recording medium between the press roller and the application roller, to press the recording medium against the application roller to transfer the treatment agent liquid on the application roller onto the recording medium;

a plurality of cartridges, each of which is configured to contain the treatment agent liquid, to be exchangeably installed in a cartridge installation unit, and to be equipped with an IC chip;

a reader/writer configured to read and write information from and to the IC chip;

a treatment agent liquid supply route configured to connect each of the installed cartridges and the supplying pan;

a supplying pump configured to be placed on the treatment agent liquid supply route;

a plurality of supply valves, one of which is placed for each of the cartridges and is used for selecting a cartridge for supplying the treatment agent liquid;

a drive time measurement unit configured to measure a drive time of the supplying pump; and a release time measurement unit configured to measure a release time of the supplying valve, wherein, based on an overlapped time between the drive time of the supplying pump measured by the drive time measurement unit and the release time of the supplying valve measured by the release time measurement unit, a supplied amount of the treatment agent liquid supplied from the cartridge to the supplying pan is calculated, and a liquid weight information in which the supplied amount is subtracted is written by the reader/writer onto the IC chip, with which the cartridge for supplying the treatment agent liquid selected by the supplying valve is equipped.

4. The treatment agent liquid application apparatus for an inkjet printer as claimed in claim 3, further comprising an empty detection unit configured to detect that the cartridge becomes empty of the treatment agent liquid, wherein when it is detected that the cartridge becomes empty by the empty detection unit, information indicating the cartridge is empty is written by the reader/writer onto the IC chip with which the cartridge is equipped.

* * * * *